US007708002B2

(12) United States Patent
Gerardo

(10) Patent No.: US 7,708,002 B2
(45) Date of Patent: May 4, 2010

(54) PRESSURIZED AIR SHOOTING DEVICE

(76) Inventor: Martin Gerardo, RR 1 P.O. Box 1779A, Saylorsburg, PA (US) 18353

( * ) Notice: Subject to any disclaimer, the term of this patent is extended or adjusted under 35 U.S.C. 154(b) by 0 days.

(21) Appl. No.: 11/877,791

(22) Filed: Oct. 24, 2007

(65) Prior Publication Data

US 2008/0099004 A1 May 1, 2008

Related U.S. Application Data

(63) Continuation-in-part of application No. 11/387,439, filed on Mar. 23, 2006, now abandoned.

(60) Provisional application No. 60/665,590, filed on Mar. 25, 2005, provisional application No. 60/974,828, filed on Sep. 24, 2007.

(51) Int. Cl.
*F41B 11/00* (2006.01)

(52) U.S. Cl. ..... 124/73; 70/71

(58) Field of Classification Search ..... 124/70, 124/71, 73–77
See application file for complete search history.

(56) References Cited

U.S. PATENT DOCUMENTS

| | | | | |
|---|---|---|---|---|
| 3,680,540 | A * | 8/1972 | Stengl | 124/73 |
| 3,989,246 | A * | 11/1976 | Brown et al. | 473/431 |
| 4,079,937 | A * | 3/1978 | Kirsch | 273/317.3 |
| 4,207,857 | A * | 6/1980 | Balka, Jr. | 124/56 |
| 5,823,173 | A * | 10/1998 | Slonaker et al. | 124/56 |
| 6,416,428 | B1 * | 7/2002 | Tygar et al. | 473/415 |
| 6,807,959 | B1 * | 10/2004 | Murdock et al. | 124/61 |
| 2003/0069091 | A1 * | 4/2003 | Wengert | 473/409 |
| 2003/0089361 | A1 * | 5/2003 | Christensen | 124/77 |
| 2007/0193569 | A1 * | 8/2007 | Ho et al. | 124/80 |
| 2007/0209649 | A1 * | 9/2007 | Jones | 124/73 |

* cited by examiner

*Primary Examiner*—Troy Chambers
*Assistant Examiner*—Gabriel J Klein
(74) *Attorney, Agent, or Firm*—Muskin & Cusick LLC

(57) ABSTRACT

An air pressure gun to shoot a projectile, such as a golf ball, long distances using pressurized air. A flapper makes an air-tight seal with an air duct to prevent air from leaking out of an air chamber. When a triggering mechanism releases the flapper, pressurized air from the air chamber can then swing the flapper open, thereby shooting the golf ball out of a barrel.

7 Claims, 14 Drawing Sheets

PRESSURIZED AIR SHOOTING DEVICE

CROSS REFERENCE TO RELATED APPLICATIONS

This application is a continuation in part of application Ser. No. 11,387,439, filed Mar. 23, 2006 now abandoned which claims benefit to provisional application 60/665,590, filed Mar. 25, 2005 both of which are incorporated by reference herein in its entirety. This application also claims benefit to provisional application 60/974,828, filed Sep. 24, 2007 which is incorporated by reference herein in its entirety.

BACKGROUND OF THE INVENTION

1. Field of the Invention

The present inventive concept relates to an air cannon that shoots pressurized air, and more particular an air cannon that can accommodate a golf ball.

2. Description of the Related Art

Golf is a difficult sport which can only be enjoyed by experienced players that are able to hit reasonable shots on the course. Novices or parties that are not physically fit (e.g. the elderly) are typically unable to play golf on a typical golf course.

What is needed is a way for novices to play golf on a typical course, which can by accomplished by using pressurized air cannon that can shoot a golf ball a long distance.

SUMMARY OF THE INVENTION

It is an aspect of the present invention to provide an air cannon capable of shooting a golf ball a long distance.

The above aspects can be obtained by an apparatus that includes (a) a base comprising an air chamber; (b) a barrel connected to the base; (c) an air duct connected to the base, the air duct comprising a hole; (d) a flapper pivotally attached to the base forming an airtight seal with the air duct when the flapper is in a closed position; and (e) a trigger mechanism securing and releasing the flapper, (f) wherein when the trigger mechanism releases the flapper, the flapper pivots into an open position allowing air to flow from the air chamber to the barrel.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
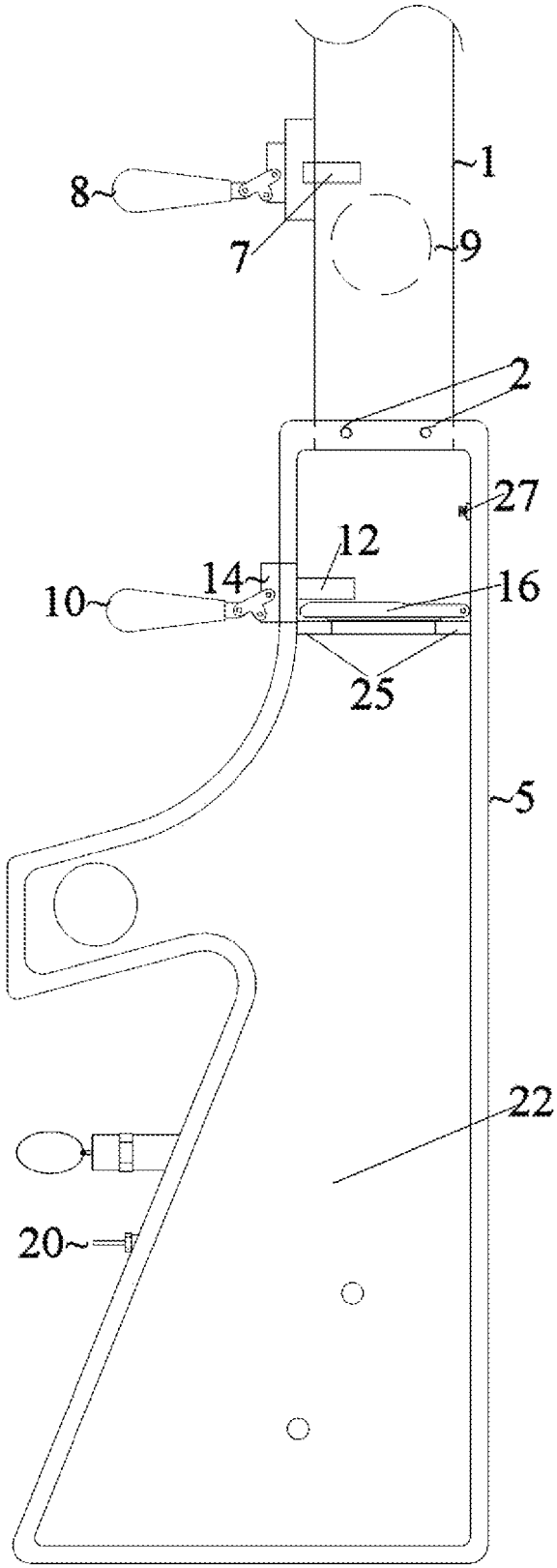
FIG. 1 is a drawing illustrating an air gun base attached to a barrel, according to an embodiment.

Reference will now be made in detail to the presently preferred embodiments of the invention, examples of which are illustrated in the accompanying drawings, wherein like reference numerals refer to like elements throughout.

The present general inventive concept relates to a gun adapted to receive a golf ball which can project the golf ball at a far distance.

FIG. 1 is a drawing illustrating an air gun base attached to a barrel, according to an embodiment.

A detachable barrel 1 is attached to a base 5 using hex nuts 2. The barrel 1 can also have a threaded end which can screw into a threaded end on the base 5. A safety piston 7 is used as a safety mechanism to prevent a golf ball 9 from being accidentally shot through the barrel 1. A safety release mechanism 8 is a lever (or trigger, etc.) used to lower the safety piston 7. Thus, when the safety is on, the safety piston 7 is extended into the barrel 1, thereby preventing the golf ball 9 from leaving the barrel 1. When the safety release mechanism is activated (pressed, pulled, etc.) the safety piston 7 retracts into a retracted position (see FIG. 13), allowing the golf ball 9 to leave the barrel 1. If a loaded (with a golf ball 9) gun is fired if the safety piston 7 is extended, then air pressure will press against the golf ball 9 but it will not be able to pass the safety piston 7 and will not leave the barrel 1. A trigger 10 is used to shoot the golf ball 9.

The gun can operate as follows. Air can be pumped into the gun using an air inlet 20. A pump (mechanical or electronic) can be connected to the air inlet 20 to fill the air chamber 22 with air. The air chamber 22 is a hermetically sealed hollow chamber that can store air which is used to propel a projectile (such as a golf ball).

When the trigger 10 is pulled (or pushed), it causes a piston 12 to retract into the piston housing 14, thereby freeing a flapper 16 to open. When the chamber is filled with air, the air pressure will press against the flapper. In the closed position, the piston 12 prevents the flapper 16 from opening. However, when the piston 12 is retracted (after activation of the trigger 10), the air pressure in the air chamber 22 will press against the flapper 16 causing it to open. The air flows from the air chamber to the flapper through an air duct 25.

Once the flapper opens, the air presses against the projectile causing it to quickly leave the barrel 1. A stopper 27 is used to cushion the impact of the flapper with an impact section 29 of the base 5. The stopper 27 can be a spring, rubber, or other mechanism which can cushion the flapper 16 so that the impact of the flapper 16 with the impact section 29 will not cause damage to the impact section 29 and hence the base 5.

The trigger 10 and safety release mechanism 8 can be any type of mechanical (or electronic) lever release mechanism, wherein when a handle (or lever is pulled, or pushed) a cooperating piston (or rod, etc.) moves. Such a mechanism can be, for example, a straight line clamp, an air cylinder valve (such as a bimba air cylinder), an electronic trigger, or any other such apparatus. More particular, the trigger 10 and safety release mechanism 8 can both be a straight line action clamp available from the Destaco company, part number 602.

Figure 2:
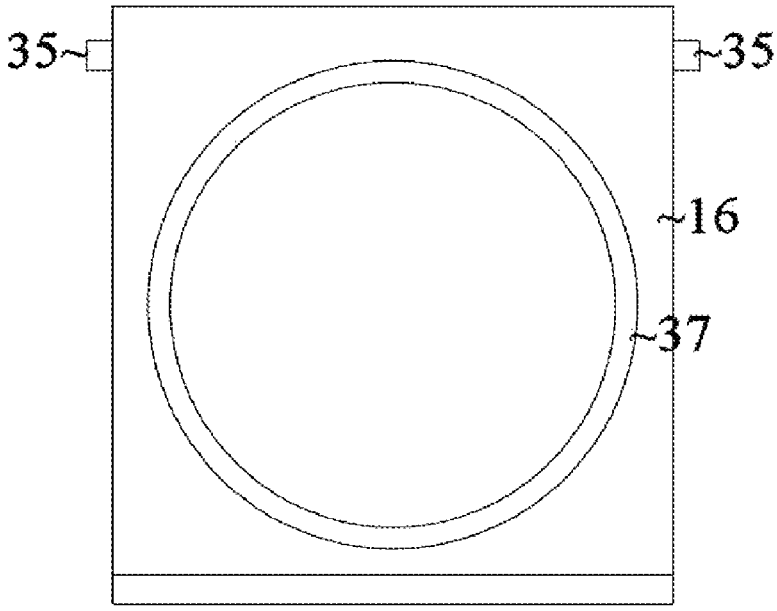
FIG. 2 is a drawing illustrating a front view of a flapper, according to an embodiment.

FIG. 2 is a drawing illustrating a front view of a flapper, according to an embodiment.

The flapper 16 has pivot sections 35 to connect to the base 5 and allowing the flapper to pivot (rotate) in order to open and close. The flapper 16 also has an indented portion 37 which is used to create a hermetic (airtight) seal with the air duct 25. In the closed position, the indented portion 37 presses against the air duct 25 to ensure the air in the air chamber 22 is not release when the flapper 16 is in the closed position. The indented portion 37 is illustrated to be circular, but it can be in any other shape as long as it matches a shape of the air duct 25. The indented portion 37 can be made out of rubber or other material (preferably malleable) to help create an airtight seal.

Figure 3:
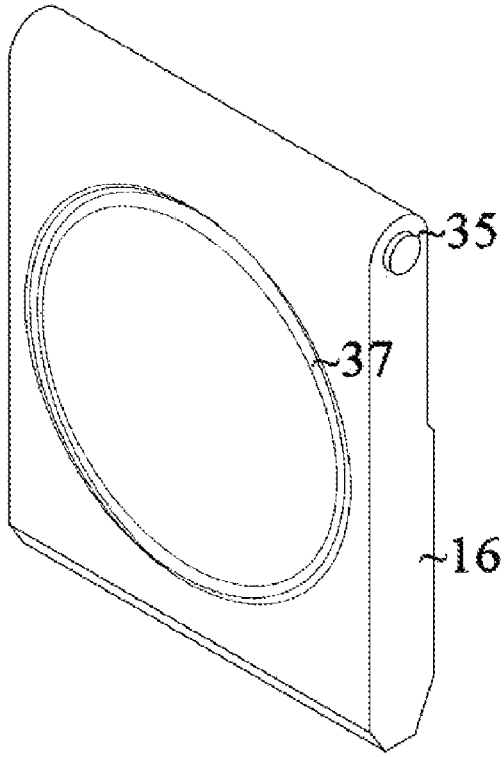
FIG. 3 is a drawing illustrating an orthographic view of a flapper, according to an embodiment.

FIG. 3 is a drawing illustrating an orthographic view of a flapper, according to an embodiment.

Figure 4:
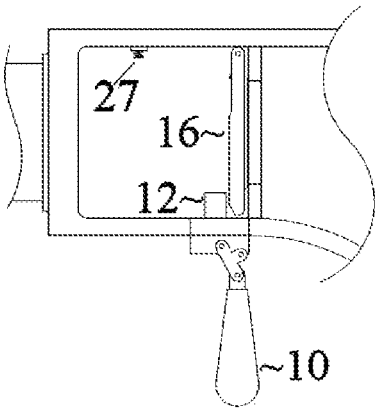
FIG. 4 is a drawing illustrating an air release mechanism that pivots on top in a closed position, according to an embodiment.

FIG. 4 is a drawing illustrating an air release mechanism that pivots on top in a closed position, according to an embodiment.

The trigger 10 cooperates with a piston 12 such that when the trigger 10 is pulled (or pushed), the piston 12 lowers, thereby freeing the flapper 16 to open. The stopper 27 is used to cushion an impact from the flapper 16 and the base 5. The stopper can be any cushioning mechanism, such as a spring, rubber, etc.

Figure 5:
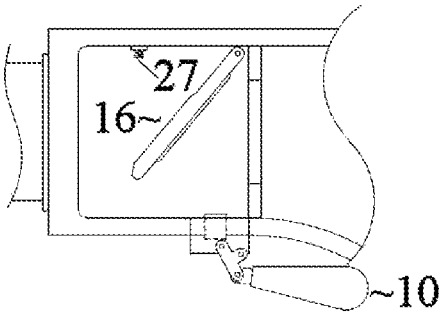
FIG. 5 is a drawing illustrating an air release mechanism that pivots on top in a half-open position, according to an embodiment.

FIG. 5 is a drawing illustrating an air release mechanism that pivots on top in a half-open position, according to an embodiment.

The trigger 40 has been activated (pushed or pulled), thereby allowing the flapper to open.

Figure 6:
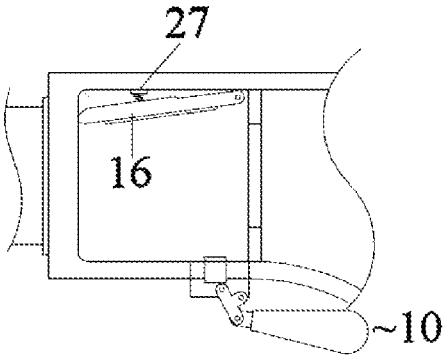
FIG. 6 is a drawing illustrating an air release mechanism that pivots on top in an open position, according to an embodiment.

FIG. 6 is a drawing illustrating an air release mechanism that pivots on top in an open position, according to an embodiment.

Here, the air pressure from the air chamber has pressed the flapper 16 in the fully extended position, where it makes an impact with the stopper 27. The air has now left the air chamber and has hurled the projectile (e.g., a golf ball) outside of the barrel of the gun.

Figure 7:
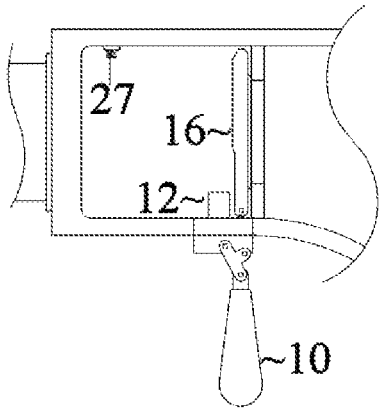
FIG. 7 is a drawing illustrating an air release mechanism that pivots on bottom in a closed position, according to an embodiment.

FIG. 7 is a drawing illustrating an air release mechanism that pivots on bottom in a closed position, according to an embodiment.

FIG. 7 is similar to FIG. 4, but in FIG. 7, the flapper pivots from a bottom of the flapper.

Figure 8:
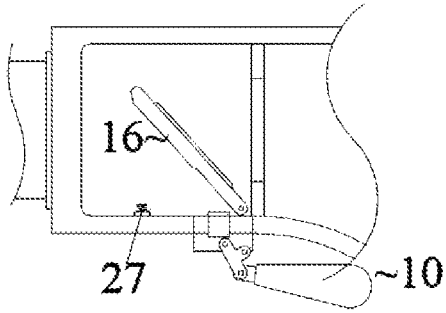
FIG. 8 is a drawing illustrating an air release mechanism that pivots on bottom in a half-open position, according to an embodiment.

FIG. 8 is a drawing illustrating an air release mechanism that pivots on bottom in a half-open position, according to an embodiment.

The flapper is illustrated pivoting from the bottom.

Figure 9:
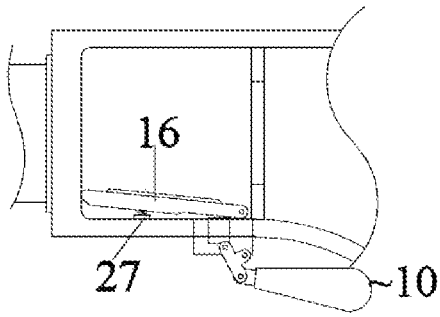
FIG. 9 is a drawing illustrating an air release mechanism that pivots on bottom in an open position, according to an embodiment.

FIG. 9 is a drawing illustrating an air release mechanism that pivots on bottom in an open position, according to an embodiment.

The flapper is in the fully open position, where the flapper impacts the stopper.

Figure 10:
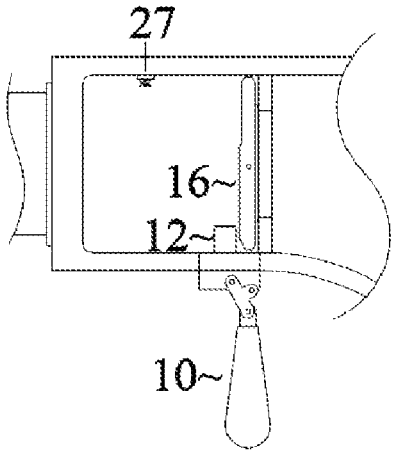
FIG. 10 is a drawing illustrating an air release mechanism that pivots in a middle in a closed position, according to an embodiment.

FIG. 10 is a drawing illustrating an air release mechanism that pivots in a middle in a closed position, according to an embodiment.

FIG. 10 is similar to FIG. 4, but in FIG. 10, the flapper pivots from a middle of the flapper.

Figure 11:
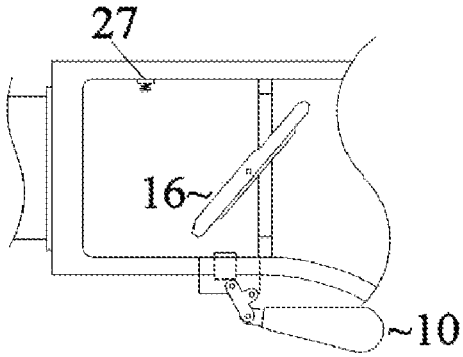
FIG. 11 is a drawing illustrating an air release mechanism that pivots in a middle in a half-open position, according to an embodiment.

FIG. 11 is a drawing illustrating an air release mechanism that pivots in a middle in a half-open position, according to an embodiment.

The flapper is illustrated pivoting in the middle.

Figure 12:
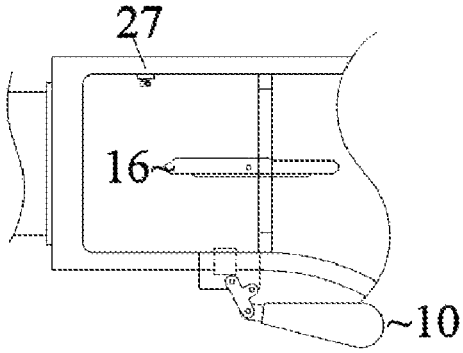
FIG. 12 is a drawing illustrating an air release mechanism that pivots in a middle in an open position, according to an embodiment.

FIG. 12 is a drawing illustrating an air release mechanism that pivots in a middle in an open position, according to an embodiment.

The flapper is in the fully open position.

Figure 13:
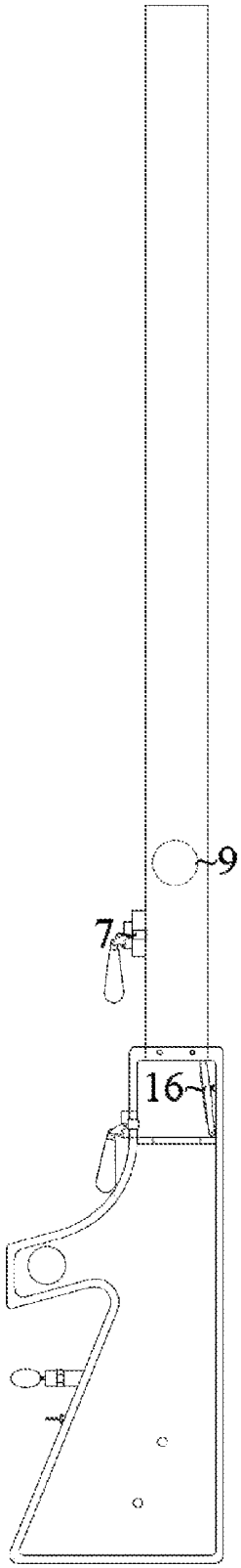
FIG. 13 is a drawing illustrating an air gun shooting a golf ball, according to an embodiment.

FIG. 13 is a drawing illustrating an air gun shooting a golf ball, according to an embodiment.

The trigger has been activated (after the air chamber is filled with air), thereby releasing air pressure which causes the flapper 16 to open, thereby hurling a golf ball 9 out of the barrel.

Note that safety 7 has been activated, thereby retracting the safety piston so that the golf ball can leave the barrel. If the safety had not been activated (thus the safety piston is in the extended state), the flapper would open but the safety piston would prevent the golf ball from leaving the barrel.

Figure 14:
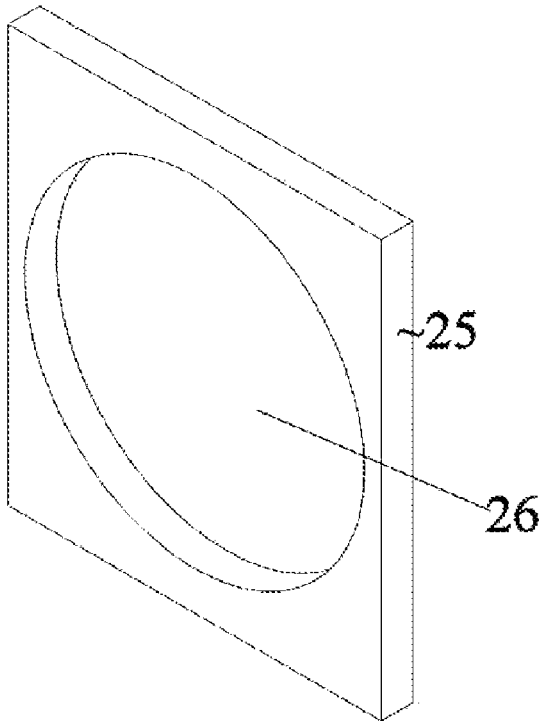
FIG. 14 is an orthographic view of an air duct, according to an embodiment.

FIG. 14 is an orthographic view of an air duct, according to an embodiment.

The air duct 25 has a circular hole 26 inside the air duct 25, thereby allowing air to pass through the air duct. The air duct 25 is permanently attached inside the base 5 (e.g., welded, glued, or any other attachment mechanism) and does not move.

The indented portion 37 of the flapper 16 is adapted to seal around the circular hole 26 to create an airtight seal between the flapper 16 and the air duct 25. In other words, the indented portion 37 serves as lips which seal around the circular hole 26 of the stationary air duct 25.

Figure 15:
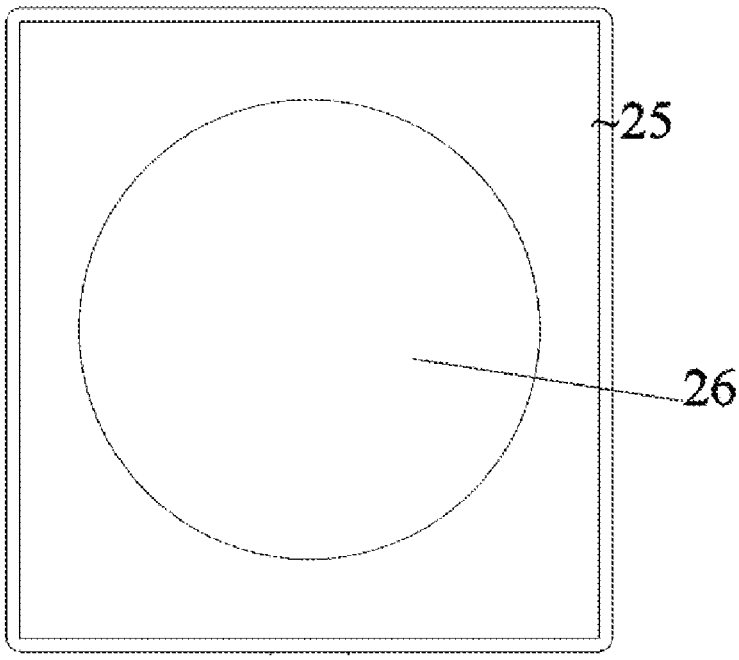
FIG. 15 is a front view of the air duct, according to an embodiment.

FIG. 15 is a front view of the air duct, according to an embodiment.

A square shaped air duct 25 contains a hole 26. The indented portion 37 of the flapper 16 serves as an airtight seal around the hole 26 when the flapper is in the closed position (preventing air from leaving the chamber). When the gun is loaded and ready to fire the flapper 16 would be in the closed position, while after the gun is fired (and the air chamber is released of its air), the flapper 16 would swing into an open position, although the flapper may fall back into the closed position on its own (for example due to gravity and an orientation of the gun).

Pivot section 35 attaches the flapper 16 to the base allowing the flapper 16 to pivot around the pivot section 35 (rotate).

Figure 16:
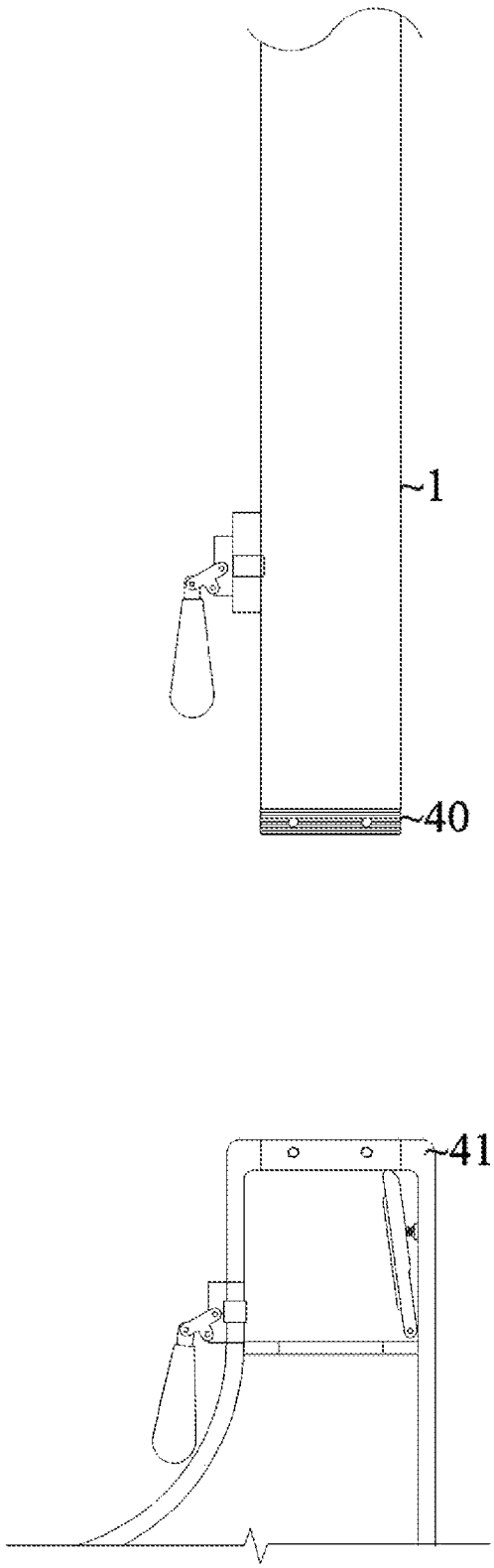
FIG. 16 is a drawing of a barrel disconnected from a base, according to an embodiment.

FIG. 16 is a drawing of a barrel disconnected from a base, according to an embodiment.

The barrel 1 can contain a male threaded end 40 which can attach to the base by screwing the male threaded end 40 into a female threaded end 41 in the base. This attachment method can be used in place of, or in addition to, screwing in hex nuts as previously described.

Figure 17:
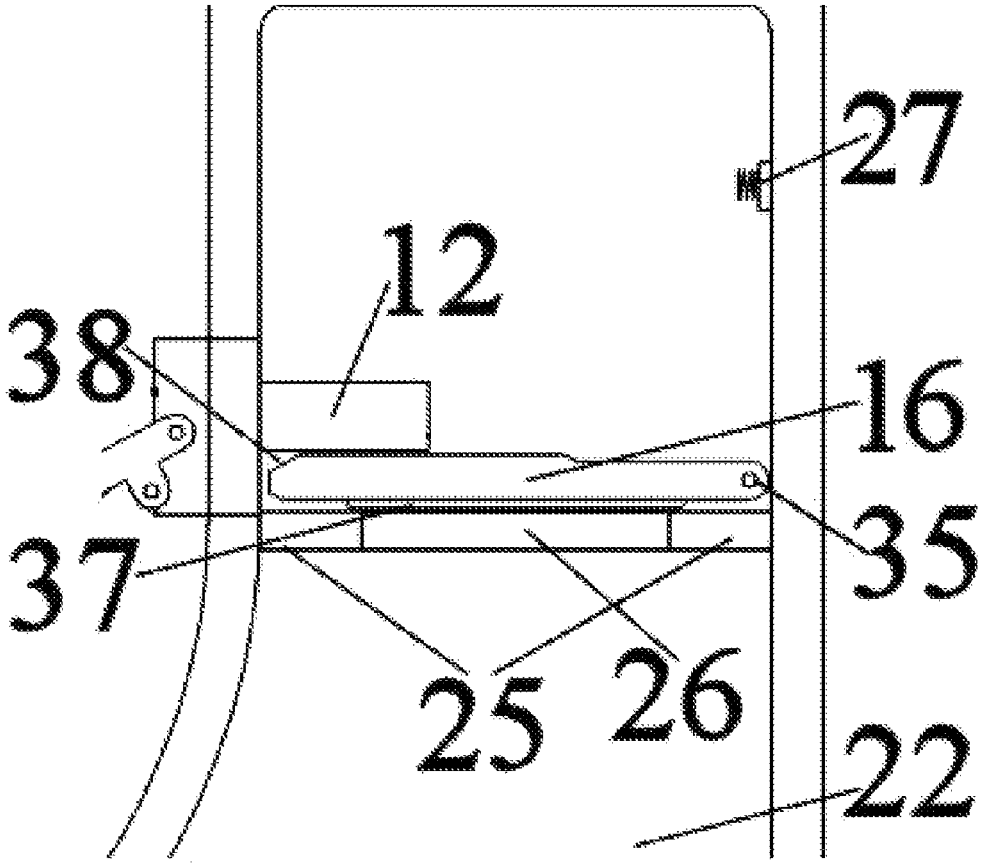
FIG. 17 is an enlargement of the flapper and surrounding apparatus, according to an embodiment.

FIG. 17 is an enlargement of the flapper and surrounding apparatus, according to an embodiment.

Note how the indented portion 37 attached to the flapper 16 surrounds the hold 26 in the air duct 25, forming an airtight seal therein. Air cannot escape from the (hollow) air chamber 22 while the flapper is in the closed position. The piston 12 (when extended) locks against the flapper 16. An angled portion 38 of the flapper 16 allows the piston 12 to extend from the retracted position and slide behind the flapper 16 to extend and lock the flapper 16 in the closed position. The stopper 27 is shown herein as a spring, although it can also comprise other structures (rubber, plastic, a malleable material, etc.)

Figure 18:
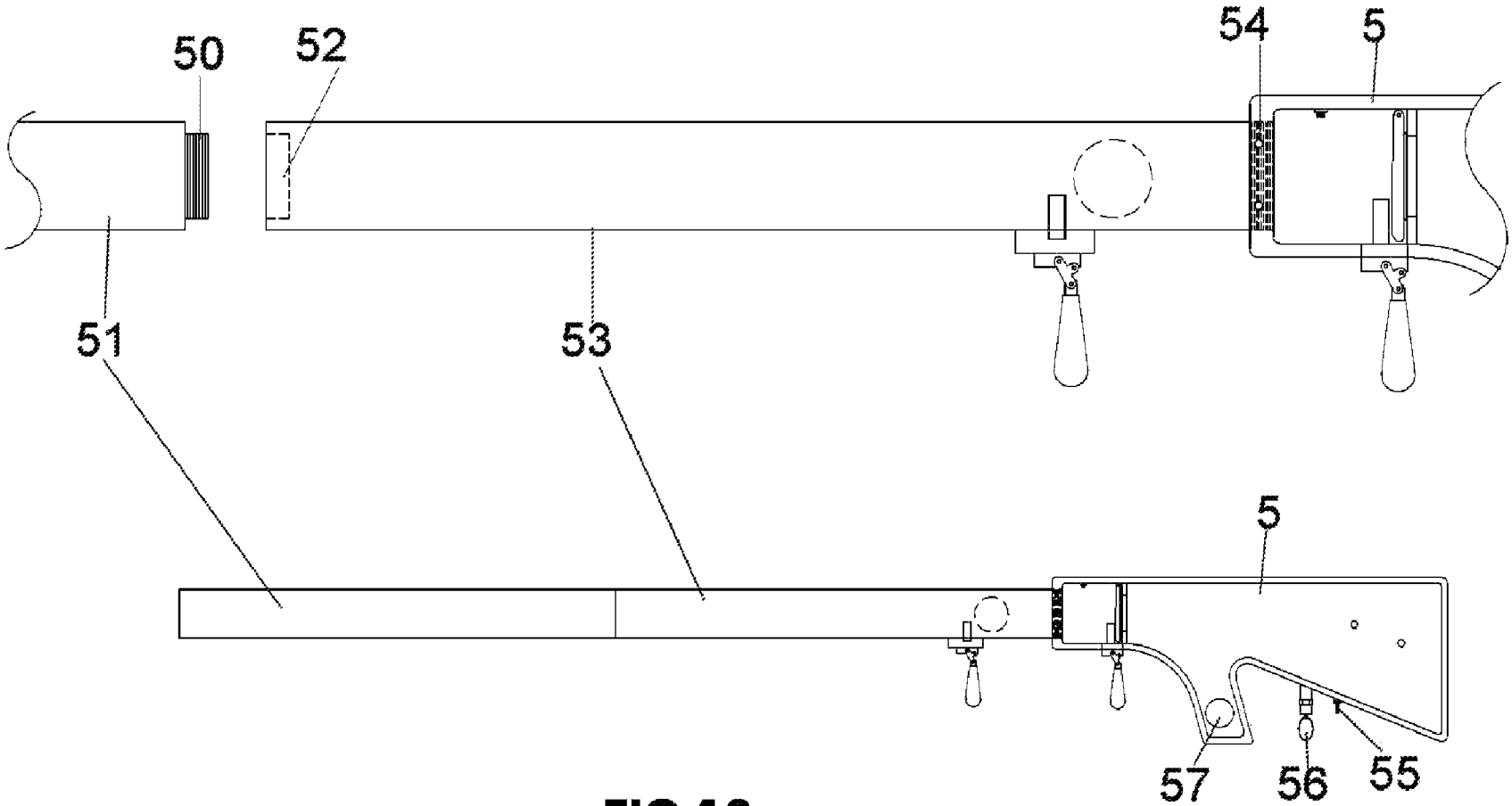
FIG. 18 is a drawing illustrating an air gun and barrel comprised of at least two attachable pieces.

FIG. 18 is a drawing illustrating an air gun and barrel comprised of at least two attachable pieces.

The barrel of the air gun can actually be comprised of two (or more) pieces. This is advantageous because to allow the barrel to disassemble would make it easier for storage. Additionally, barrels of different lengths may allow for different average distances that a golf ball can be shot out of the gun. For example, a longer barrel (e.g., a barrel comprised of two sections or pieces) may allow for a longer shot (since there may be more time for the air to put pressure on the ball), while a short barrel may result in a shorter shot.

A first barrel section 51 can attach to a second barrel section 53 by any connection mechanism, such as threading (e.g., an end of the first barrel can screw into an end of the second barrel). A male threaded end 50 in the first barrel section 51 can screw into a cooperating female threaded end 52, attaching the first barrel section 51 securely to the second barrel section 53. The first barrel section 51 can then be detached from the second barrel section 53 by unscrewing the sections. Thus, the two sections are removably attached, since they can be manually attached and removed. Note that the first barrel section 51 can also removably attach to the second barrel section 53 by using a coupling (made of plastic or any other material). For example, a hollow cylindrical coupling can receive each end of the first barrel section 51 and the second barrel section 53 and grip then both via friction.

The second barrel section 53 can attach to the base 5 also by using threaded ends (or other attaching mechanism such as hex nuts, etc.) A female threaded end 54 can receive the threaded end 40 (see FIG. 16) of the second barrel section 53. As discussed above, the gun can be shot with either the second barrel section 53 attached to the first barrel section 51, or with just the second barrel section 53 not attached to the first barrel section 51. However, it is not recommend to shoot the gun without the second barrel section 53 attached.

An air pressure gage 57 can be used to show the air pressure inside the base 5. The operator would not want the air pressure to exceed a certain level or the base may be placed under excessive pressure, which may cause damage to the gun. Thus, the operator should watch the air pressure gage 57 as the operator is filling the base 5 with air.

A safety release 56 is a safety mechanism whereby the safety release 56 would automatically pop out if the air pressure inside the base exceeds a predetermined level. If the safety release 56 pops out, then air in the base 5 is released outside of the gun, removing excess pressure in the base 5.

An air intake valve 55 is used to fill the base 5 with air. A pump can be connected to the air intake valve 55 in order to fill the base 5 with air. After the base 5 is filled with air, the pump can be detached from the air intake valve 55.

Note that any measurements can be used for the size of the gun and parts. For example, The barrel can be a total of 32 inches (a 12 inches for the first barrel section and 20 inches for the second barrel section). The base can be 16 inches long and 7 inches high and approximately 2.25 inches wide. The flapper can be 2 inches high, 1.75 inches wide, and three eights (3/8) of an inch thick. Of course, any other measurements can be used and these are merely examples. The components can be made of any material, such as steel, aluminum (or aluminum alloy), Iron, etc.

Figure 19A:
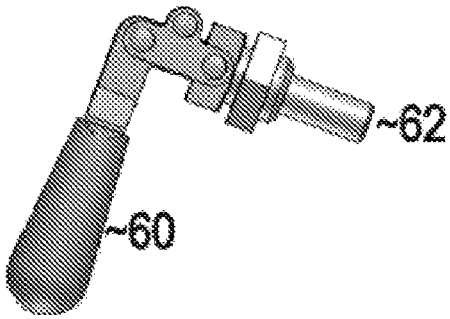
FIG. 19A is a front view of a trigger mechanism, according to an embodiment.
Figure 19B:
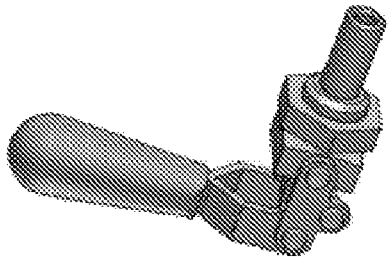
FIG. 19B is an orthographic view of a trigger mechanism, according to an embodiment.
Figure 19C:
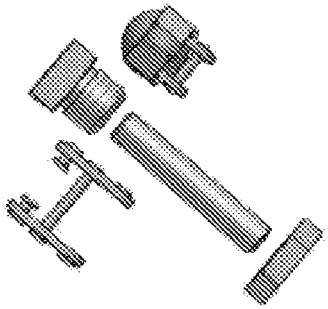
FIG. 19C is a disassembled view of a trigger mechanism, according to an embodiment.
Figure 19D:
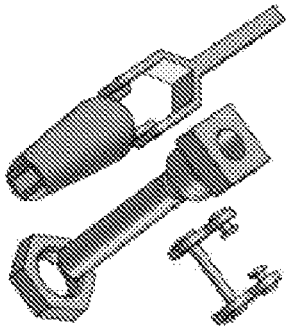
FIG. 19D is a further disassembled view of a trigger mechanism, according to an embodiment.
Figure 19E:
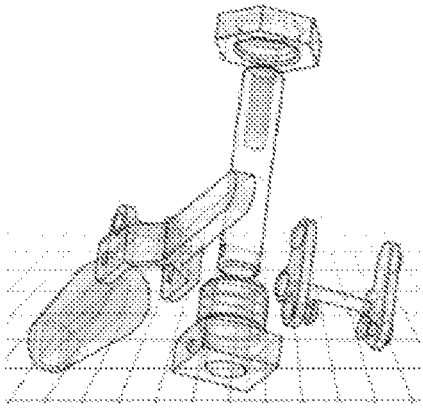
FIG. 19E is a wireframe view of a trigger mechanism, according to embodiment.

FIG. 19A is a front view of a trigger mechanism, according to an embodiment. FIG. 19B is an orthographic view of a trigger mechanism, according to an embodiment. FIG. 19C is a disassembled view of a trigger mechanism, according to an embodiment. FIG. 19D is a further disassembled view of a trigger mechanism, according to an embodiment. FIG. 19E is a wireframe view of a trigger mechanism, according to embodiment.

Note that FIGS. 19A-19E are included to illustrated just one example of a device that can be used for the trigger 10 and/or the safety release mechanism 8. More particular, these figures illustrate a Straight Line Action Clamp (part 602) from the Destaco company, but any other triggering mechanism can be used.

Figure 20:
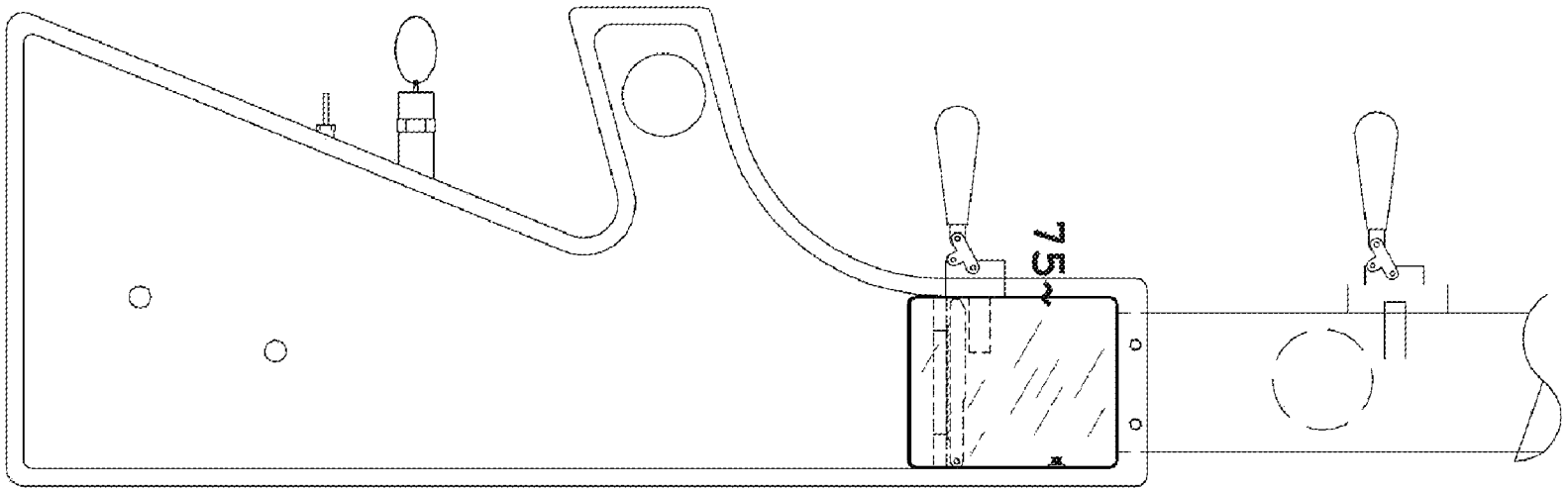
FIG. 20 is a drawing of an air gun with a transparent panel, according to an embodiment

FIG. 20 is a drawing of an air gun with a transparent panel, according to an embodiment.

A transparent panel 75 can be used to cover a rectangular area on a side of the gun. The transparent panel 75 can be made out of any transparent material, such as LEXAN, shatterproof glass, etc. Using the transparent panel 75 can be beneficial in that the operator can visually inspect and see if the flapper is in the closed and locked position (secured behind the piston 12 of the trigger 10) before pumping the air chamber with air.

Figure 21A:
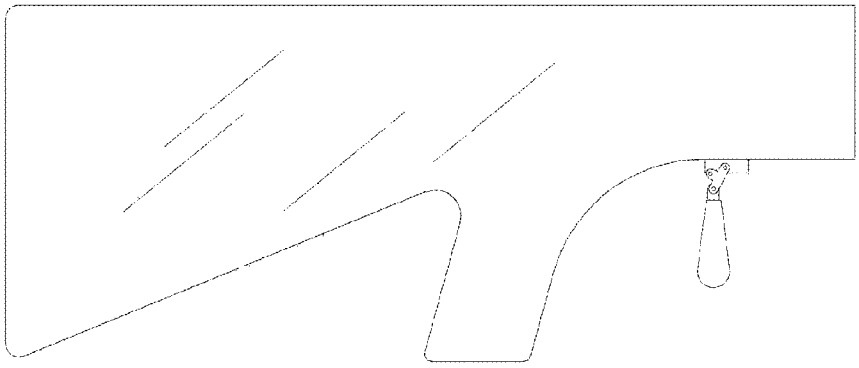
FIG. 21A is a front side drawing of an air gun base.
Figure 21B:
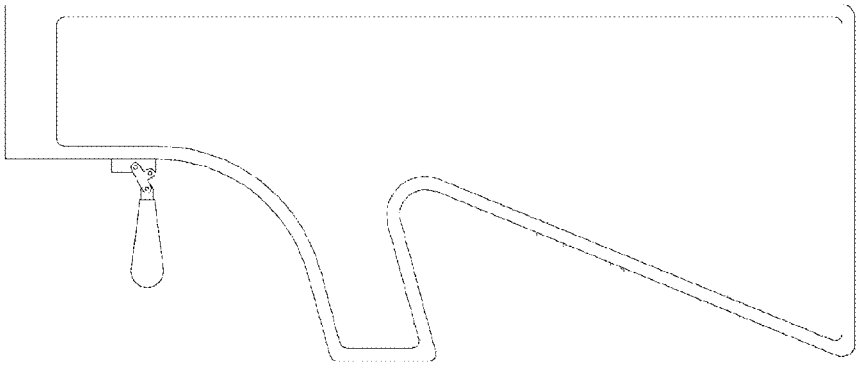
FIG. 21B is a rear side drawing of an air gun base.
Figure 22:
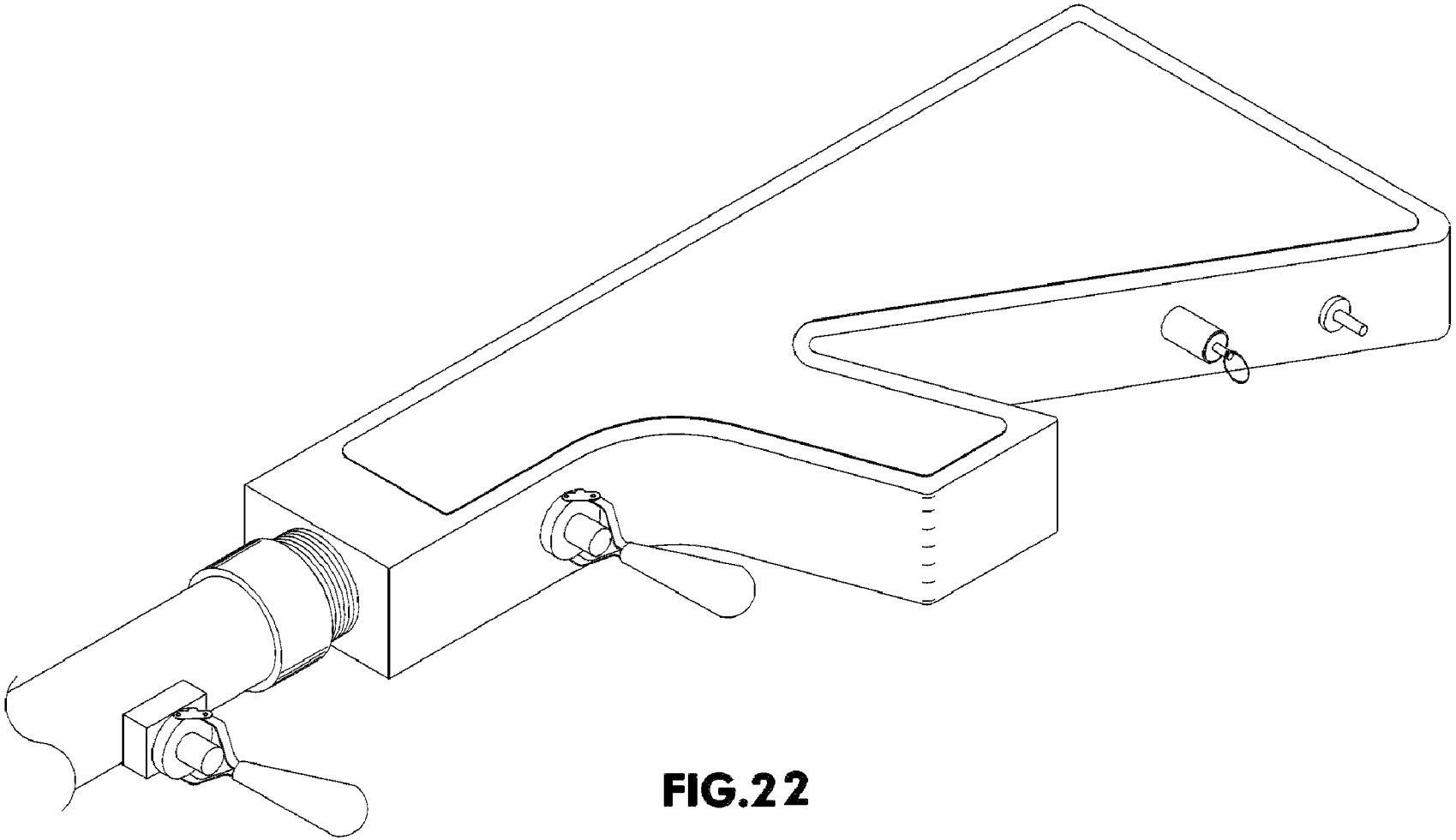
FIG. 22 is an orthographic view of an air gun.
Figure 23:
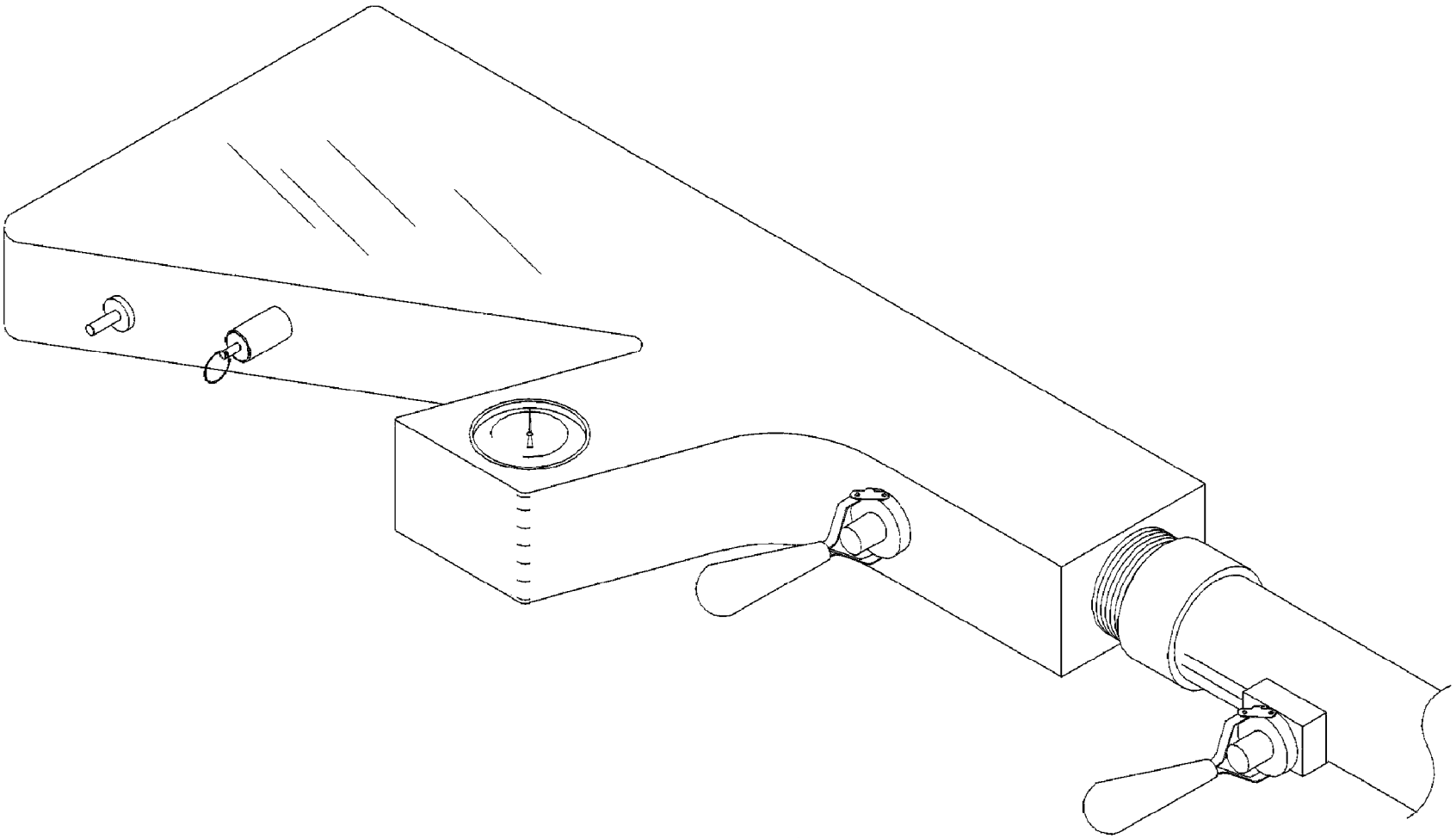
FIG. 23 is a further orthographic view of an air gun.

FIG. 21A is a front side drawing of an air gun base. FIG. 21B is a rear side drawing of an air gun base. FIG. 22 is an orthographic view of an air gun. FIG. 23 is a further orthographic view of an air gun.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. An air pressure gun, the gun comprising:

a base comprising an air chamber;

a barrel connected to the base;

an air duct connected to the base, the air duct being a plate having a hole in a center of the air duct, a diameter of the hole being approximately equal to a diameter of a golf ball, the hole being aligned with an inside of the barrel;

a flapper pivotally attached to the base positioned adjacent to the air duct and closer to the barrel than the air duct, the flapper comprising an indented portion, the indented portion surrounding the hole in the air duct and forms an airtight seal between the flapper and the air duct when the flapper is in a closed position; and a trigger mechanism configured to be switched into an unlocked and locked position, the locked position securing the flapper in the closed position which presses the indented portion of the flapper against the air duct, the air duct and flapper collectively sealing the air chamber from the barrel when the flapper is in the closed position, wherein when the trigger mechanism is in the unlocked position, the trigger mechanism releases the flapper, and the flapper is able to pivot into an open position allowing air to flow from the air chamber to the barrel.

2. The air pressure gun as recited in claim 1, further comprising:

a safety trigger mechanism connected to the barrel, the safety trigger mechanism comprising a handle and a piston;

wherein the safety piston in the extended position prevents a projectile from escaping the barrel by blocking the projectile, wherein the safety piston in the retracted position allows the projectile to escape the barrel, wherein the handle can be activated to place the safety piston in the extended position or retracted position.

3. The air pressure gun as recited in claim 1, wherein the barrel is comprised of a first section and a second section, wherein the first section is removably attached to the second section.

4. The air pressure gun as recited in claim 3, wherein the first section comprises a first threaded end and the second section comprises a second threaded end, wherein the first threaded end is adapted to screw into the second threaded end to attach the first section to the section.

5. The air pressure gun as recited in claim 1, wherein the trigger mechanism is an action clamp.

6. The air pressure gun as recited in claim 2, wherein the safety trigger mechanism is an action clamp.

7. The air pressure gun as recited in claim 1, further comprising a transparent panel on a side of the air pressure gun adjacent to the flapper allowing visual inspection of the flapper's position from outside of the air pressure gun.

* * * * *